US008978757B2

(12) United States Patent
Wang et al.

(10) Patent No.: US 8,978,757 B2
(45) Date of Patent: Mar. 17, 2015

(54) REMOTE ACTUATION TESTING TOOL FOR HIGH PRESSURE DIFFERENTIAL DOWNHOLE ENVIRONMENTS

(75) Inventors: Wei Wang, Sugar Land, TX (US); Colin Longfield, Sugar Land, TX (US); David Merlau, Friendswood, TX (US); Sebastian Ives, Pearland, TX (US); Brad Bailey, Katy, TX (US); Belinda D. Manning, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 475 days.

(21) Appl. No.: 13/329,462

(22) Filed: Dec. 19, 2011

(65) Prior Publication Data

US 2012/0186825 A1 Jul. 26, 2012

Related U.S. Application Data

(63) Continuation-in-part of application No. 12/505,340, filed on Jul. 17, 2009, now Pat. No. 8,220,533.

(60) Provisional application No. 61/428,754, filed on Dec. 30, 2010, provisional application No. 61/427,402, filed on Dec. 27, 2010, provisional application No. 61/081,465, filed on Jul. 17, 2008.

(51) Int. Cl.

| | |
|---|---|
| ***E21B 34/06*** | (2006.01) |
| ***E21B 34/10*** | (2006.01) |
| ***E21B 49/08*** | (2006.01) |

(52) U.S. Cl.

CPC ..... *E21B 34/10* (2013.01); *E21B 49/087* (2013.01)

USPC ..... 166/250.15; 166/264; 166/66.7

(58) Field of Classification Search

USPC ..... 166/250.15, 264, 53, 66.6, 66.7

See application file for complete search history.

(56) References Cited

U.S. PATENT DOCUMENTS

| | | | |
|---|---|---|---|
| 4,896,722 | A | 1/1990 | Upchurch |
| 4,915,168 | A | 4/1990 | Upchurch |
| 5,354,032 | A | 10/1994 | Sims et al. |
| 5,779,149 | A | 7/1998 | Hayes, Jr. |
| 6,012,518 | A | 1/2000 | Pringle et al. |
| 6,017,016 | A | 1/2000 | Jackson |
| 6,213,203 | B1 | 4/2001 | Edwards et al. |
| 6,244,351 | B1 | 6/2001 | Patel et al. |
| 6,253,736 | B1 | 7/2001 | Crofts et al. |
| 6,321,845 | B1 | 11/2001 | Deaton |
| 6,354,374 | B1 | 3/2002 | Edwards et al. |
| 6,359,569 | B2 | 3/2002 | Beck et al. |
| 6,433,991 | B1 | 8/2002 | Deaton et al. |

(Continued)

OTHER PUBLICATIONS

International Search Report and Written Opinion issued in PCT/US2011/066693 on Jul. 31, 2012, 10 pages.

*Primary Examiner* — William P Neuder

(57) ABSTRACT

A remote actuation tool equipped with an intermediate volumetric mechanism for enhanced tool durability in high pressure differential downhole environments. Valve segments of the tool are actuated by power available due to a pressure differential between atmospheric and hydrostatic chambers of the tool. Yet, the intermediate volumetric mechanism, whether in the form of a discrete chamber or a hydraulic line system, minimizes stresses of the differential pressure on tool hydraulics. Thus, failure rates are substantially reduced. So, for example, the tool may be reliably employed in downhole environments which present differential pressures in excess of about 30,000 PSI.

18 Claims, 7 Drawing Sheets

(56) References Cited

U.S. PATENT DOCUMENTS

| | | | |
|---|---|---|---|
| 6,478,090 | B2 | 11/2002 | Deaton |
| 6,655,654 | B1 | 12/2003 | Cotton, III et al. |
| 7,111,675 | B2 | 9/2006 | Zisk, Jr. |
| 7,198,250 | B2 | 4/2007 | East |
| 7,322,376 | B2 | 1/2008 | Frisch |
| 7,331,398 | B2 | 2/2008 | Dwivedi et al. |
| 7,337,850 | B2 | 3/2008 | Contant |
| 7,373,972 | B2 | 5/2008 | Ocalan |
| 7,464,761 | B2 | 12/2008 | Hosatte et al. |
| 7,854,267 | B2 | 12/2010 | Smith et al. |
| 8,570,832 | B2 * | 10/2013 | Rayssiguier et al. ..... 367/82 |
| 2001/0035509 | A1 | 11/2001 | Chase et al. |
| 2002/0121134 | A1 | 9/2002 | Sweetland et al. |
| 2004/0020657 | A1 | 2/2004 | Patel |
| 2005/0173564 | A1 | 8/2005 | Cooke |
| 2007/0007014 | A1 | 1/2007 | Sessions et al. |
| 2009/0101329 | A1 | 4/2009 | Clem et al. |
| 2009/0183919 | A1 | 7/2009 | Hall et al. |
| 2009/0194289 | A1 | 8/2009 | Clem |
| 2010/0012313 | A1 | 1/2010 | Longfield et al. |

* cited by examiner

REMOTE ACTUATION TESTING TOOL FOR HIGH PRESSURE DIFFERENTIAL DOWNHOLE ENVIRONMENTS

PRIORITY CLAIM/CROSS REFERENCE TO RELATED APPLICATION(S)

This patent Document claims priority under 35 U.S.C. §119 to U.S. Provisional App. Ser. No. 61/427,402, filed on Dec. 27, 2010, and entitled, "High Pressure High Temperature (HPHT) Well Tool Control System and Method", and also to U.S. Provisional App. Ser. No. 61/428,754, filed on Dec. 30, 2010, and entitled "IRDV Tool for HPHT Environments", both of which incorporated herein by reference in their entireties. This Patent Document is also a continuation-in-part claiming priority under 35 U.S.C. §120 to U.S. application Ser. No. 12/505,340, entitled "Downhole Piezoelectric Devices", filed Jul. 17, 2009, and which claims priority to Provisional App. Ser. No. 61/081,465, filed on Jul. 17, 2009, and entitled "Piezoelectric Actuator and Pump in Oilfield Application", both of which are incorporated herein by reference in their entireties.

BACKGROUND

Exploring, drilling, completing, and operating hydrocarbon and other wells are generally complicated, time consuming and ultimately very expensive endeavors. In recognition of these expenses, added emphasis has been placed on well access, monitoring and management throughout the productive life of the well. That is to say, from a cost standpoint, an increased focus on ready access to well information and/or more efficient interventions have played key roles in maximizing overall returns from the completed well.

By the same token, added emphasis on completions efficiencies may also play a critical role in maximizing returns. That is, enhancing efficiencies over the course of well testing, hardware installation and other standard up front tasks may also ultimately improve overall returns on the significant investments placed in well completions. For example, a host of well testing applications may be run upon completion of initial drilling operations but in advance of casing and other hardware installations. Such tests may be carried out by a testing tool outfitted with a ball valve, a circulation valve, and other features directed at acquiring flow, pressure, and other downhole data.

The described 'dual valve' testing tool may be utilized in conjunction with temporary packer-based drill stem isolation. Thus, the tool may be delivered to a known downhole location, acquire relevant sampling information, and be moved to another location for repeating of the data acquisition process.

Given ever increasing well depths and other factors, the dual valve testing tool may be configured to operate as described without the use of heavy cabling. For example, valve actuation may be triggered by way of pressure pulse signaling from surface. Thus, the dual valve tool is often referred to as an 'intelligent remote' dual valve tool or "IRDV tool" with different pressure pulse signatures from surface signaling different valve opening and closing actuations.

Once more, power requirements for valve shifting and other actuations may be met by taking advantage of the natural differential pressure that exists between the downhole environment and the atmospheric pressure provided to the tool from the oilfield surface. In fact, even powering requirements for solenoid triggering of such actuations may be met by use of small scale piezo-material. As such, the overall IRDV tool footprint and testing deployment weight may be kept to a minimum.

Unfortunately, given the ever increasing well depths and the incomplete, largely uncontrolled, nature of the well at this stage of completions, the testing environment may be particularly challenging in terms of the high temperatures and differential pressures involved. For example, the hydraulic nature of the tool may result in hydrostatic pressure hydraulics (i.e. in communication with the downhole environment) that may be in excess of 30,000 PSI above the atmospheric pressure hydraulics (i.e. determined at the oilfield surface).

While the described differential certainly provides more than enough potential power for driving the noted actuations, the differential may be more than the hydraulics of the tool are able to maintain throughout testing operations. For example, the architectural layout of tool components may lead to thinner walled or less structurally sound regions of atmospheric pressure hydraulics. These locations may be susceptible to failure when faced with holding back such dramatically high pressures. Further, the failure rate may be exacerbated where similarly dramatic high temperatures are found downhole.

Ultimately, due to tool failure rates of IRDV tools in such high pressure incomplete wells, operators may elect to employ alternate, more cumbersome, modes of power and actuation. However, as a practical matter, IRDV tools as described are generally employed with failure resulting in significant cost and time delays associated with re-outfitting, positioning, and testing of various well locations.

SUMMARY

A downhole tool is provided which is configured for remote actuation in a well from an oilfield surface. The tool includes one chamber for exposure to downhole well pressure and another which is at about an atmospheric pressure found at the oilfield surface. An intermediate volumetric mechanism is provided which is in fluid communication with the chambers and configured to retain fluid pressure at a level that is between the different pressures of the chambers. This mechanism may be of a discrete intermediate pressure chamber or take the form of a hydraulic line system of the tool. Additionally, fluid pressure into the mechanism from the one chamber may be governed by a regulator thereof whereas fluid pressure release into the other chamber from the mechanism may be governed by a relief valve thereof.

DETAILED DESCRIPTION

Embodiments are described with reference to certain tool enhancements for a remote actuation testing tool (i.e. IRDV tool). More specifically, enhancements are directed at improving durability of tool segments upon exposure to harsh high pressure downhole environments. Along these lines, tool embodiments are provided with unique pressure accommodating hydraulics, reduced gun-drill hydraulics, an improved pilot valve and other durability enhancing features. Regardless, embodiments of testing tools detailed herein may include an intermediate volumetric mechanism configured to retain an intermediate pressure in a manner so as to reduce the degree of differential pressure at the interface of atmospheric and hydrostatic chambers of the tool.

Figure 1:
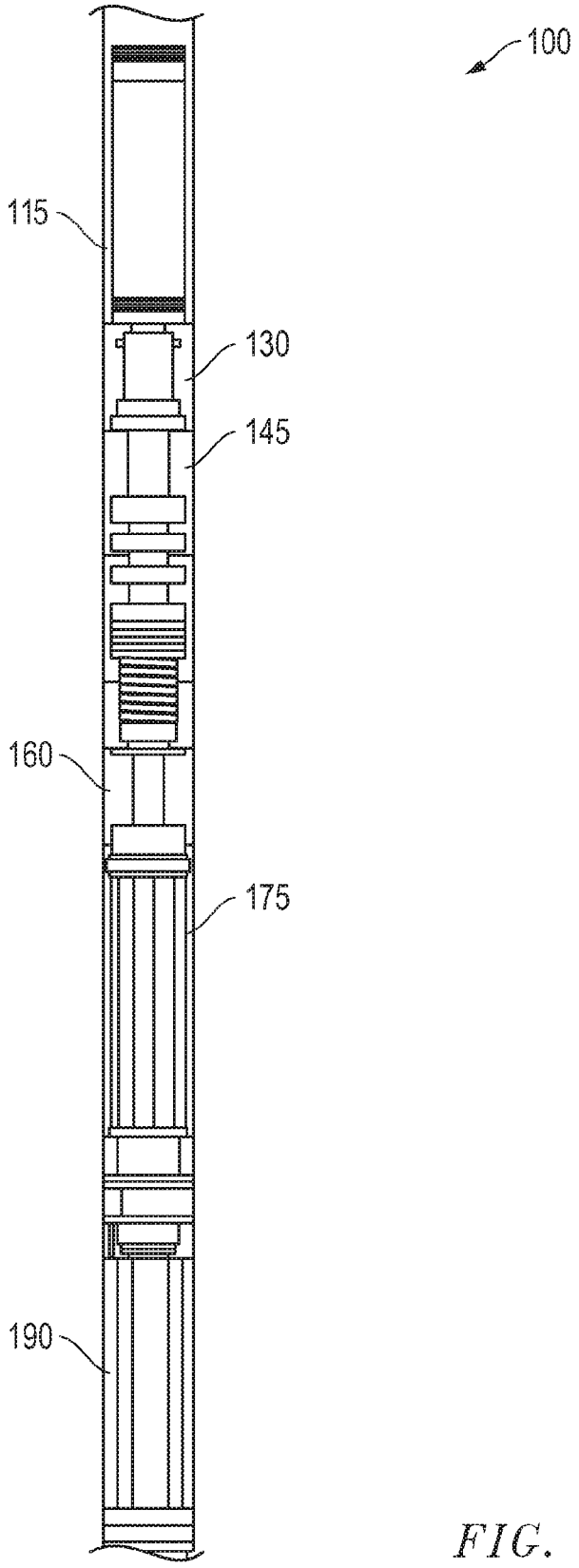
FIG. 1 is a front view of an embodiment of a remote actuation testing tool of enhanced high pressure differential capacity.

Referring now to FIG. 1, a front view of an embodiment of a remote actuation testing tool 100 is depicted. The tool 100 is of enhanced durability, particularly in terms of high pressure differential capacity. So, for example, the tool 100 is outfitted with circulating 130 and testing 145 valve segments. These segments 130, 145 are actuated via power drawn from an inherent differential that exists between atmospheric 175 and hydrostatic 115 chambers of the tool 100.

Figure 2:
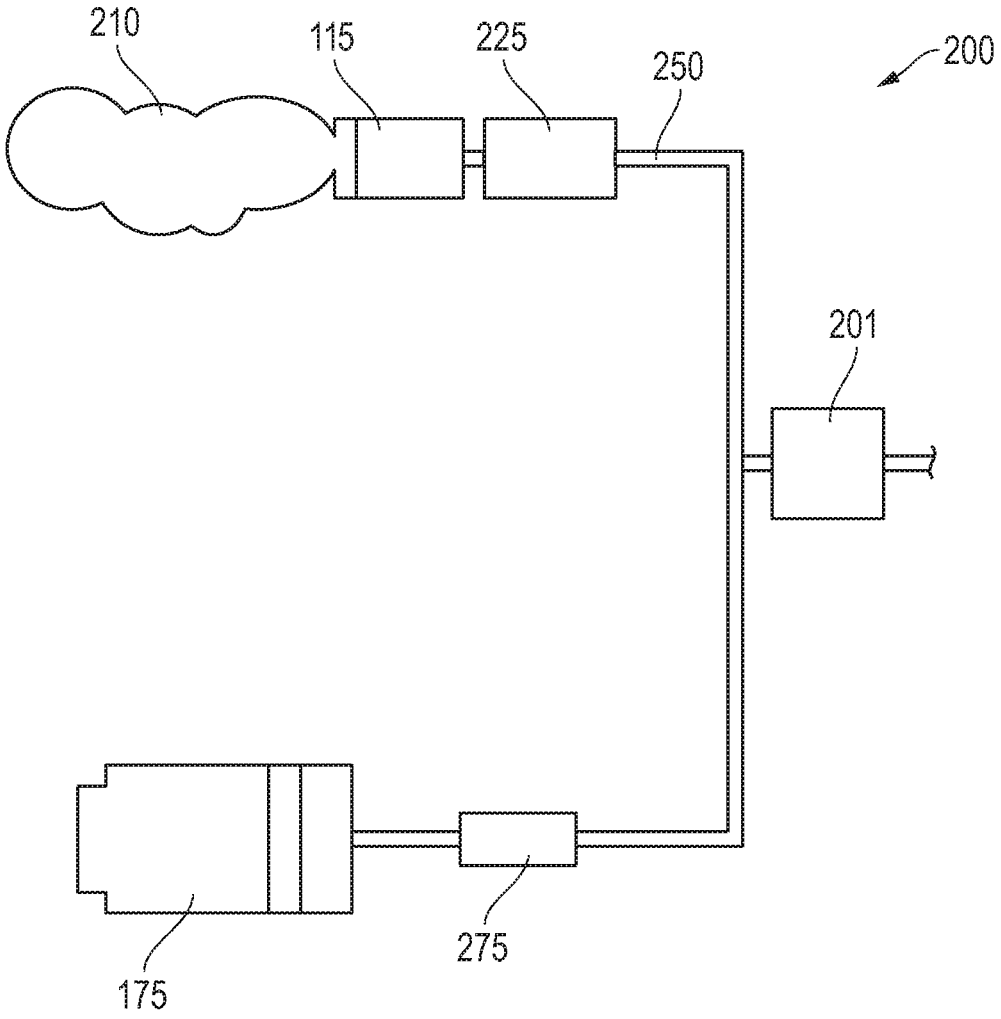
FIG. 2 is a schematic representation of an embodiment of a hydraulic layout for the tool of FIG. 1.

However, with added reference to FIG. 2, an intermediate volumetric mechanism 200 may be provided so as to accommodate a certain degree of pressure and reduce the overall differential imparted on weak hydraulic tool components. As a result, hydraulic failure due to extreme differential at this location may be reduced. So for example, in one embodiment, downhole pressure might dictate an overall differential of about 35,000 PSI relative the tool 100. Nevertheless, the amount of differential actually directed at associated components, relative the volumetric mechanism 200, may be held to between about 10,000 PSI and 25,000 PSI (depending on regulator 225 and relief valve 275 settings as detailed further herein).

Continuing with reference to FIG. 1, the testing tool 100 is also equipped with a hydraulic sub 160 as well as an electronics housing 190. The sub 160 may be a conventional hydraulic sub 160 for downhole use. However, in an embodiment where the testing valve 145 is located adjacent the sub 160 such may also be configured to accommodate solenoid wiring and other features of the valve 145 as needed. Similarly, the housing 190 may be a conventional electronics housing and may even provide an added degree of processing and/or battery capacity to the tool 100. Indeed, apart from circulating or testing applications of the tool 100, other downhole applications and tools may be provided for added downhole operations which may benefit from the added processing and/or power availability. For example, note the packer 575 and perforating gun 560 of FIG. 5.

Referring more specifically now to FIG. 2, a schematic representation of an embodiment of a hydraulic layout is depicted for the tool 100 of FIG. 1. The schematic represents a simplified version of the hydraulic relationship between the hydrostatic chamber 115 and the atmospheric chamber 175 in one embodiment. More specifically, as alluded to above and detailed below, a volumetric mechanism 200 is disposed between these chambers 115, 175 which serves to minimize the amount of pressure that structurally weaker hydraulic components are exposed to between actuations. Thus, the differential pressure rating of the overall tool 100 of FIG. 1 may be significantly increased.

Figure 5:
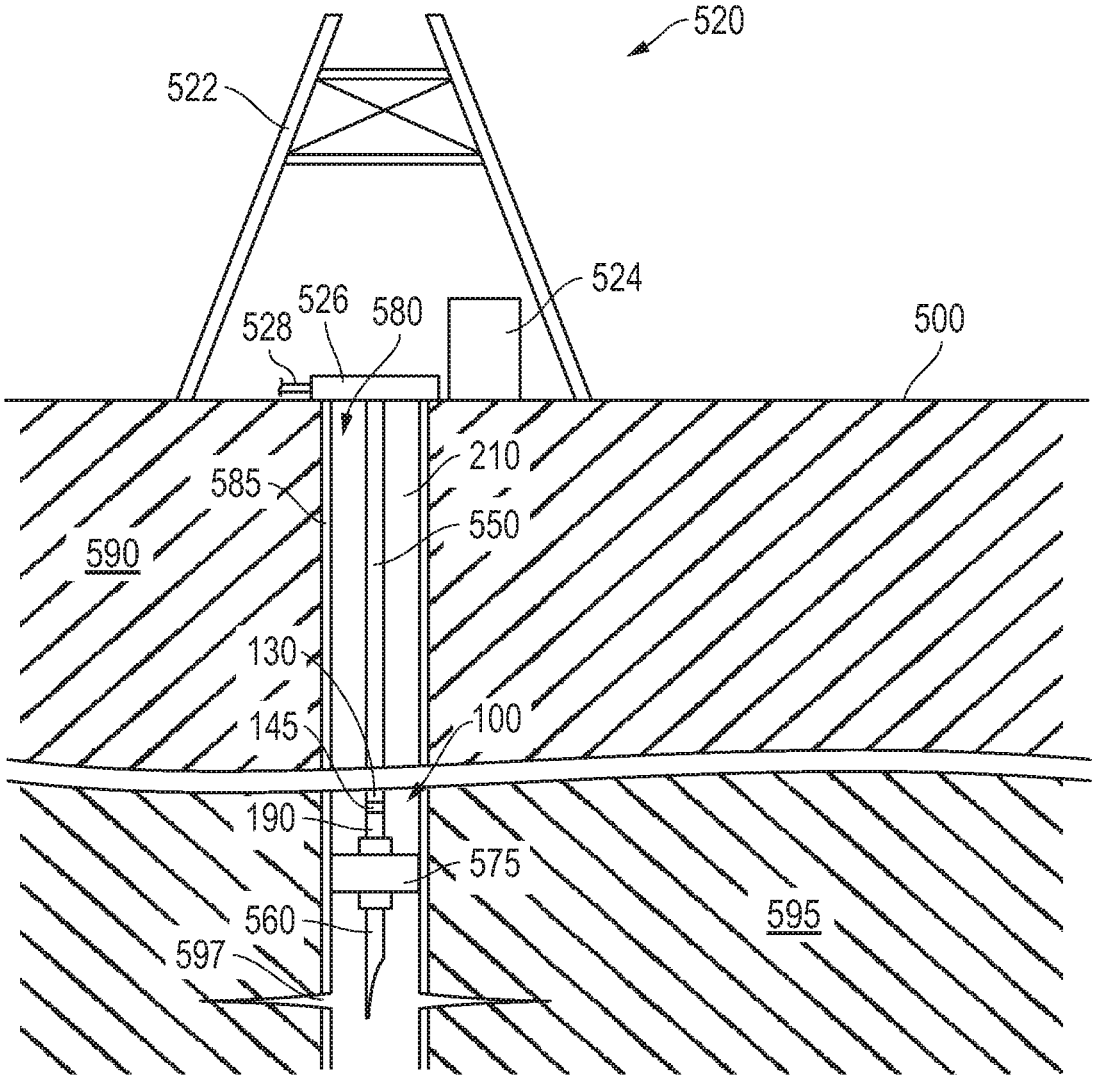
FIG. 5 is an overview of an oilfield accommodating a well and the testing tool of FIG. 1 disposed therein.

Continuing with reference to FIG. 2, with added reference to FIGS. 1 and 5, the noted actuations of the circulating 130 or testing 145 valve segments are driven by the available pressure differential that is inherently present between the chambers 115, 175. More specifically, the hydrostatic chamber 115 is openly exposed to an annular space 210 and downhole pressures of a well 580 in which the tool 100 is located. By contrast, however, the atmospheric chamber 175 is of a surface-based pressure (e.g. atmospheric pressure of below about 200 PSI) that is set in an isolated fashion at the oilfield surface 500 before deployment of the tool 100 into the well 580. Thus, depending on the depth of the well 580 and other characteristics, a pressure differential in the tens of thousands PSI may be available between the chambers 115, 175.

With added reference to FIGS. 1 and 3, the noted differential may be employed in conjunction with triggers such as solenoids (e.g. 330, 340) to controllably allow pressure breaches between the chambers 115, 175. Such controlled breaches may then be used to hydraulically drive a power piston 325 which in turn drives actuations of the circulating 130 and testing 145 valve segments. Thus, an available pressure differential, as opposed to more cumbersome power delivery, may be utilized in driving the primary valve functions of the testing tool 100.

However, unlike a conventional testing tool, the embodiment of FIGS. 2 (and 3A, 3B), are outfitted with a volumetric mechanism 200 so as to ensure pressure breaches of the atmospheric chamber 175 are limited to those actually controllably triggered as noted above. More specifically, the volumetric mechanism 200 is provided so as to retain an intermediate pressure in fluid communication with the atmospheric chamber 175. Thus, between actuations, associated tool components need not hold back the full pressure differential in order to prevent fluid leakage and hydraulic failure of the tool 100. In a practical sense, this means that and structurally weaker hydraulic components linked to the mechanism 200, may be required to effectively hold back substantially less than the overall differential. Depending on the overall tool layout, this may be particularly beneficial where more likely, other hydraulic components linked to the mechanism 200 are constructed of minimal wall thicknesses or face other pressure related design challenges.

Continuing with reference to FIG. 2, the volumetric mechanism 200 is made up of a discrete intermediate pressure chamber 201 for holding an intermediate pressure as governed by a regulator 225 and a relief valve 275. More specifically, the regulator 225 is in fluid communication with the hydrostatic chamber 225 and hydraulic lines 250 running to the intermediate pressure chamber 201 so as to govern fluid pressure into the mechanism 200. In an embodiment where the mechanism 200 is initially at atmospheric pressure, the regulator 225 may face the full differential pressure from the well annulus 210. Regardless, the relief valve 275, which is in fluid communication with the atmospheric chamber 175 via the lines 250, need not hold back the full differential pressure, but rather only the intermediate pressure of the volumetric mechanism. Perhaps more importantly, as noted above, structurally weaker hydraulic tool components may be linked to the lines 250 and need not be exposed to the full differential.

In one embodiment, the regulator 225 and relief valve 275 settings result in an intermediate pressure in the mechanism 200 that is kept at a range of 10,000-25,000 PSI, even where the full differential may be in excess of 35,000 PSI. Thus, weaker hydraulic components are exposed to substantially less than the full differential. In other embodiments, alternative pressure ranges may be utilized which are below the full differential (and above atmospheric pressure). Indeed, the regulator 225 may be an adjustable mechanical regulator. Similarly, in alternative embodiments, mechanisms that utilize a hydraulic line system 300 as opposed to a discrete chamber 201 may serve to contain the intermediate pressure (see FIGS. 3A and 3B).

Figure 3A:
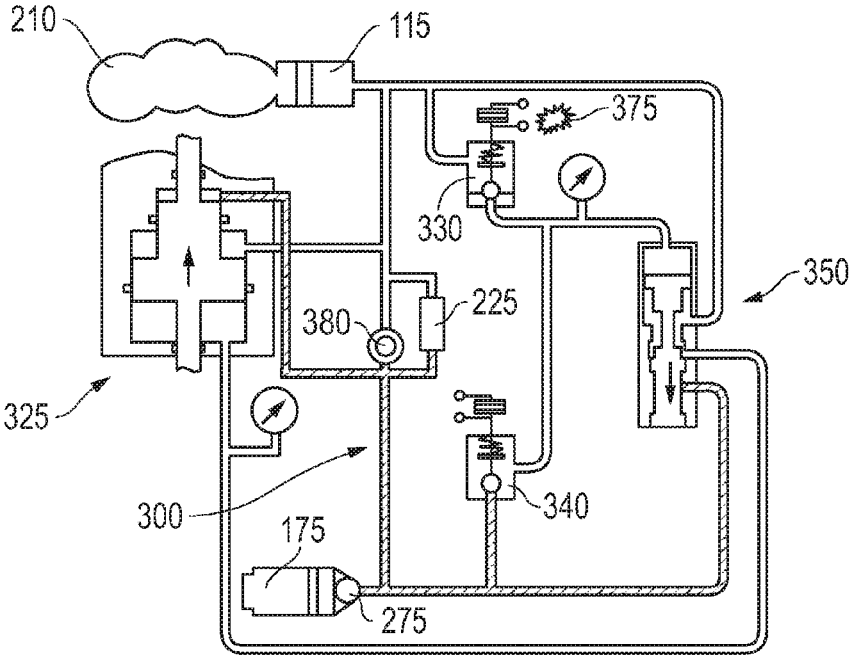
FIG. 3A is a schematic representation of alternate embodiment of a hydraulic layout for the tool of FIG. 1 upon male solenoid valve firing.
Figure 3B:
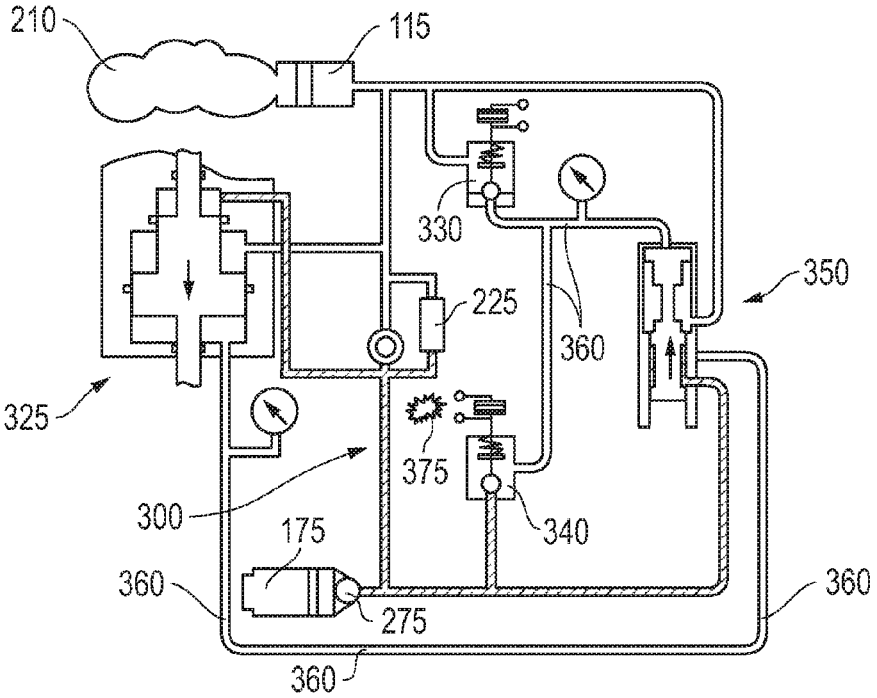
FIG. 3B is a schematic representation of the alternate embodiment of FIG. 3A upon female solenoid firing.

Referring now to FIGS. 3A and 3B, schematic representations of an alternate hydraulic layout for the tool of FIG. 1 are depicted. As noted above, in this embodiment, the discrete chamber 201 version of the volumetric mechanism 200 of FIG. 2 is replaced with one that is provided in the form of a hydraulic line system 300. Nevertheless, the hydrostatic chamber 115 is included and remains hydraulically linked to the atmospheric chamber 175 with governing regulator 225 and relief valve 275 disposed therebetween. Only, in the embodiment here, a hydraulic line system 300 accommodates the above noted intermediate pressure in the absence of any discrete chamber 201.

With specific reference to FIG. 3A, a male solenoid 330 is triggered via a signal 375 to hydraulically shift a power piston 325 which ultimately drives the valve actuations of the circulating 130 or testing 145 valve segments as described above. The solenoid 330 itself may be of piezoelectric or other low power capacity for effective response to such signaling without the requirement of any significant dedicated power source from surface or elsewhere (see U.S. application Ser. No. 12/505,340, incorporated by reference herein as noted above). Additionally, the solenoid 330 may be coupled to a sensor configured to detect pressure pulse or other suitable wireless signaling, for example as directed by a control unit 524 positioned at the oilfield 500 (see FIG. 5).

Continuing with reference to FIG. 3A, the hydraulic shift of the power piston 325 is managed through a pilot valve 350 as detailed further below. Regardless, the intermediate pressure line (i.e. the hydraulic line system 300) retains an intermediate pressure throughout this drive of the piston 325. As noted, the intermediate pressure into the system 300 is initially governed by a regulator 225. However, where appropriate, a rupture disk 380 of suitable high pressure setting may be provided so as to overcome the regulator 225 in certain circumstances. Whatever the case, other potentially weak hydraulic components coupled to the system 300 remain protected from exposure to the full pressure differential emanating from the hydrostatic chamber 115.

The appreciated benefit of protection from exposure to the full pressure differential by certain hydraulics may be even more apparent with reference to FIG. 3B. FIG. 3B is a schematic representation of the same hydraulic layout of FIG. 3A. However, in FIG. 3B, the depiction is of the female solenoid 340 firing. That is, again a signal 375 is employed to direct a solenoid 340 to ultimately drive the piston 325, this time in the opposite direction. Thereby, another actuation of the circulating 130 and/or testing 145 valve may be achieved. The driving of the piston 325 in this manner is again managed through the pilot valve 350 while retaining an intermediate pressure through the hydraulic line system 300.

In the view of FIG. 3B, the more direct relationship between the female solenoid 340 and the atmospheric chamber 175, both at the same hydraulic side of the regulator 225 clearly illustrates the benefit of the intermediate pressure in the system 300. Such pressure may overcome the relief valve 275 into the atmospheric chamber 175 as necessary. This intermediate pressure may even be utilized in return lines 360 to the male regulator 330 or back through the pilot valve 350 and over to driving of the piston 325 in the opposite direction as described. However, throughout such hydraulic routing an intermediate pressure, substantially below the full differential, is provided. As such, weaker hydraulic components or regions of the tool 100 may be hydraulically coupled for functionality without concern over failure due to inability to hold excessive pressure.

Figure 4A:
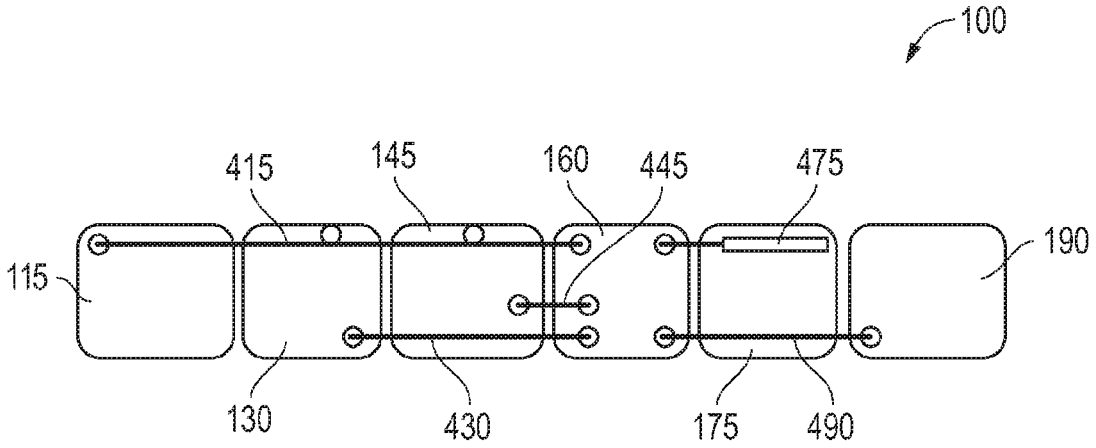
FIG. 4A is a schematic representation of the testing tool of FIG. 1 revealing an embodiment of internal gun-drill hydraulics between different tool segments.
Figure 4B:
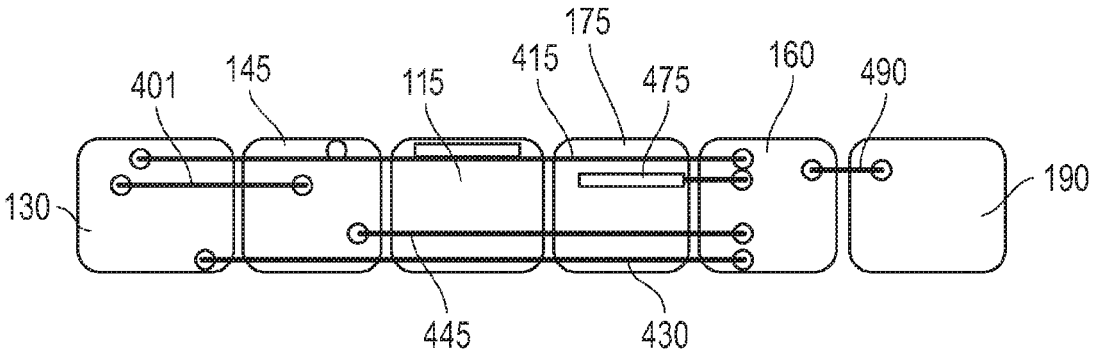
FIG. 4B (Prior Art)
FIG. 4B is a schematic representation of prior art internal gun drill hydraulics in contrast to that of FIG. 4A.

Referring now to FIGS. 4A and 4B another manner of enhancing hydraulic capacity of the tool 100 is depicted. With focus on FIG. 4A, a schematic representation of an embodiment of the testing tool 100 is shown employing a particular arrangement of tool segments 115, 130, 145, 160, 175, 190. More specifically, this arrangement is of a configuration that reduces overall gun-drill hydraulics 415, 430, 445, 475, 490 by way of contrast to a more conventional prior art arrangement as depicted in FIG. 4B.

Continuing with reference to FIG. 4A, the hydraulic sub 160 is central to the arrangement given that, just as with a conventional embodiment of FIG. 4B, each of the other segments 115, 130, 145, 175, 190 is configured for hydraulic linkage to the sub 160. Therefore, given that any increase in gun-drill hydraulics 415, 430, 445, 475, 490 is accompanied by an increase in costly machining and potential seal failure, FIG. 4A reveals an embodiment whereby segment rearrangement may be employed to reduce overall gun-drill hydraulics 415, 430, 445, 475, 490. More specifically, excluding the electronic housing 190, by positioning the hydrostatic chamber 115 and the atmospheric chamber 175 to the far ends of the tool 100, the overall footprint of the gun-drill hydraulics 415, 430, 445, 475, 490 may be kept to a minimum. This is due to the fact that these chambers 115, 175 require no direct hydraulic interface with one another.

Further, the circulating 130 and testing 145 valve segments may be disposed between the sub 160 and the hydrostatic chamber 115 which ultimately drives their actuation as described above. Thus, the gun-drill line 401 between these segments 130, 145 as shown in FIG. 4B may be eliminated. That is, due to the outermost positioning of the hydrostatic chamber 115 as shown in FIG. 4A, the hydraulic coupling between the valve segments 130, 145 may be leverage off of the same gun-drill line 415 which links the hydrostatic chamber 115 over to the sub 160.

All in all, given that each tool segment 115, 130, 145, 160, 175, 190 may be of between about 4 and 6 feet long, the amount of gun-drill line reduction may be quite significant. That is, when contrasting the prior art arrangement of FIG. 4B, note that most gun-drill lines 415, 430, 445 are reduced by at least one segment length and that another 401 is eliminated altogether in the arrangement of FIG. 4A. Thus, in terms of hydraulics, construction costs, service time, and failure risks are all substantially reduced whereas the overall reliability of the tool 100 is enhanced.

Referring now to FIG. 5, an overview of an oilfield 500 is depicted which accommodates a well 580 having an embodiment of the remote actuation testing tool 100 of FIG. 1 disposed therein. More specifically, the tool 100 is shown deployed across various formation layers 590, 595 of the well 580 via pipe 550. Once more, a conventional packer 575 and perforation gun 560 are coupled to the tool 100 as part of a larger overall bottom hole assembly. So for example, the packer 575 may be deployed for isolation at a casing 585 defining the well 580 followed by a perforation application with the gun 560 for forming perforations 597.

Of course, the testing tool 100 may be employed in absence of a packer 575 or with a variety of interventional or sampling tools other than a perforating gun 560. Indeed, due to the nature of the testing tool 100 may be utilized in advance of any casing installation or in conjunction with less interventional tools such as a conventional tail pipe and sensor assembly for positioning below the packer 575. Further, conveyance may be by alternate form of tubular or well access line.

Continuing with reference to FIG. 5, the testing tool 110 operates as detailed above. That is, a signal may be sent downhole through the annular space 210 via pressure pulse signature from a control unit 524 positioned at the oilfield 500. Thus, circulating 130 or testing 145 valve segments of the tool 100 may be actuated. Additionally, as noted above, the actuation itself may be powered by the pressure differential presented by the hydrostatic chamber 115 and its exposure to the annular space 210 at the depicted location (see FIG. 1). However, unlike a conventional testing tool, certain weaker hydraulic features of the tool 100 are spared exposure to the full measure of the differential pressure due to the incorporation of an intermediate pressure containing volumetric mechanism 200 (see FIG. 2).

FIG. 5 depicts a host of surface equipment 520 located at the oilfield 500 including a conventional rig 522, well head 526 and recovery line 528. However, it is the noted control unit 524 which may be employed to direct the actuations of the testing tool 100 as described herein. Indeed, communications from the control unit 524 may be utilized to direct other applications such as perforating or sampling, perhaps even with added support from the electronic housing 190 of the tool 100.

Figure 6:
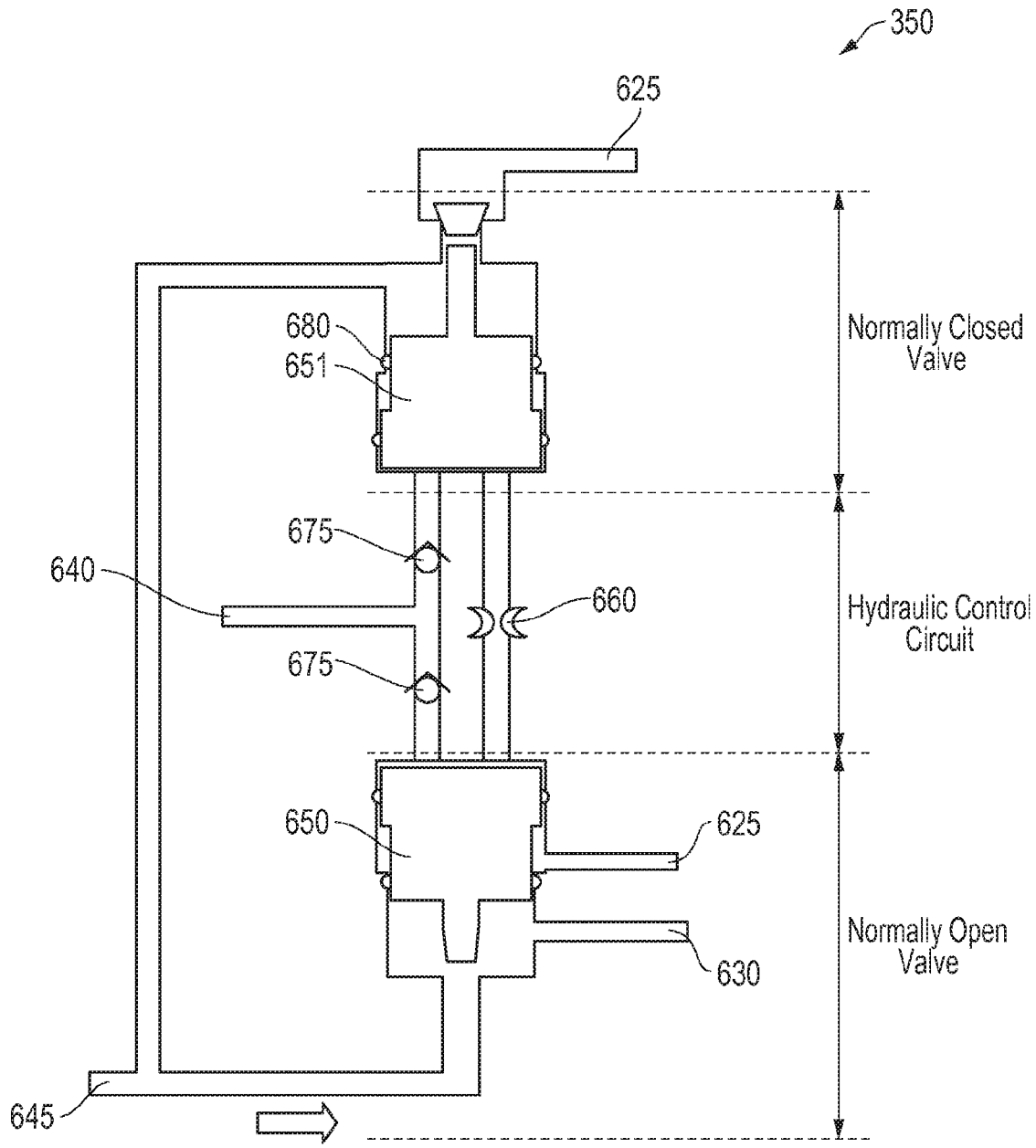
FIG. 6 is a schematic representation of an alternate embodiment of a pilot valve for use with the hydraulic layout of FIGS. 3A and 3B.

Referring now to FIG. 6, yet another manner of enhancing hydraulic capacity of the remote actuation testing tool 100 of FIG. 1 is depicted. More specifically, an alternate embodiment of the pilot valve 350 of FIGS. 3A and 3B is shown. Namely, the more unitary pilot valve 350 of FIGS. 3A and 3B is replaced with one that is segmented into a normally open valve 650 and a normally closed valve 651 with a flow restrictor 660 and check valves 675 disposed therebetween at a hydraulic control circuit. As a result, the separate valve segments 650, 651 and circuit portions may be separately installed relative the tool 100 of FIG. 1. Thus, added flexibility may be afforded in terms of pilot valve design packages that may be outfitted on the tool.

In the embodiment of FIG. 6, the pilot valve segments 650, 651 utilize metal to metal sealing by way of conventional O-rings 680 so as to provide more robust hydraulics for a high pressure differential and temperature environment. That is, elastomer seals subject to wear and failure in such environments have been replaced with the O-rings 680.

During operation of the pilot valve 350, the valve segments 650, 651 function in a manner so as to prevent excessive fluid losses from the high pressure line 625 to the low pressure line 630. Thus, the total number of actuation cycles available to the tool 100 may be increased (see FIG. 1). This is achieved through use of the hydraulic control circuit with its check valves 675 and flow restrictor 660. More specifically, these features ensure a sequential operation of the valve segments 650, 651 which assures avoidance of excessive fluid loss as noted above.

As with the embodiment of FIGS. 3A and 3B, the overall pilot valve 350 of FIG. 6 functions to amplify high pressure flow input (i.e. from the high pressure line 625). when the input pressure is higher (with a reduction in flow), the output of the valve 350 may be commensurately raised to provide a larger amount of flow.

Continuing with reference to FIG. 6, achieving the proper sequential operation of the valve segments 650, 651 so as to avoid excess fluid loss is detailed further. Namely, the segments are shown in their normally open 650 and normally closed 651 positions. At this time, the output pressure line 645 is of a comparatively low pressure. However, as the pressure increases at the 640, fluid will flow through the check valve 675 adjacent the normally open valve 650 but be unable to traverse the other check valve 675 adjacent the normally closed valve 651. As a result, the fluid will shift the normally open valve 650 (to the left in the depiction of FIG. 6) and allow fluid flow through the flow restrictor 660, eventually shifting open the normally closed valve 651. As a result, fluid loss directly from the high pressure lines 625 to the low pressure line 630 is avoided. Further, the opening of the normally closed valve 651 allows a large amount of high pressure fluid through to the output pressure line 645.

Lastly, as the pressure at the input line 640 is reduced fluid will initially flow through the check valve 675 adjacent the normally closed valve 651, but remain unable to go through the other check valve 675 adjacent the normally open valve 650. As a result, the normally closed valve 651 will be returned to its closed position (as depicted in FIG. 6). The fluid then proceeds through the flow restrictor 660 and returns the normally open valve 650 to its open position (again, as depicted in FIG. 6). As a result of such sequential operation fluid losses from the high pressure lines 625 are minimized as indicated.

Figure 7:
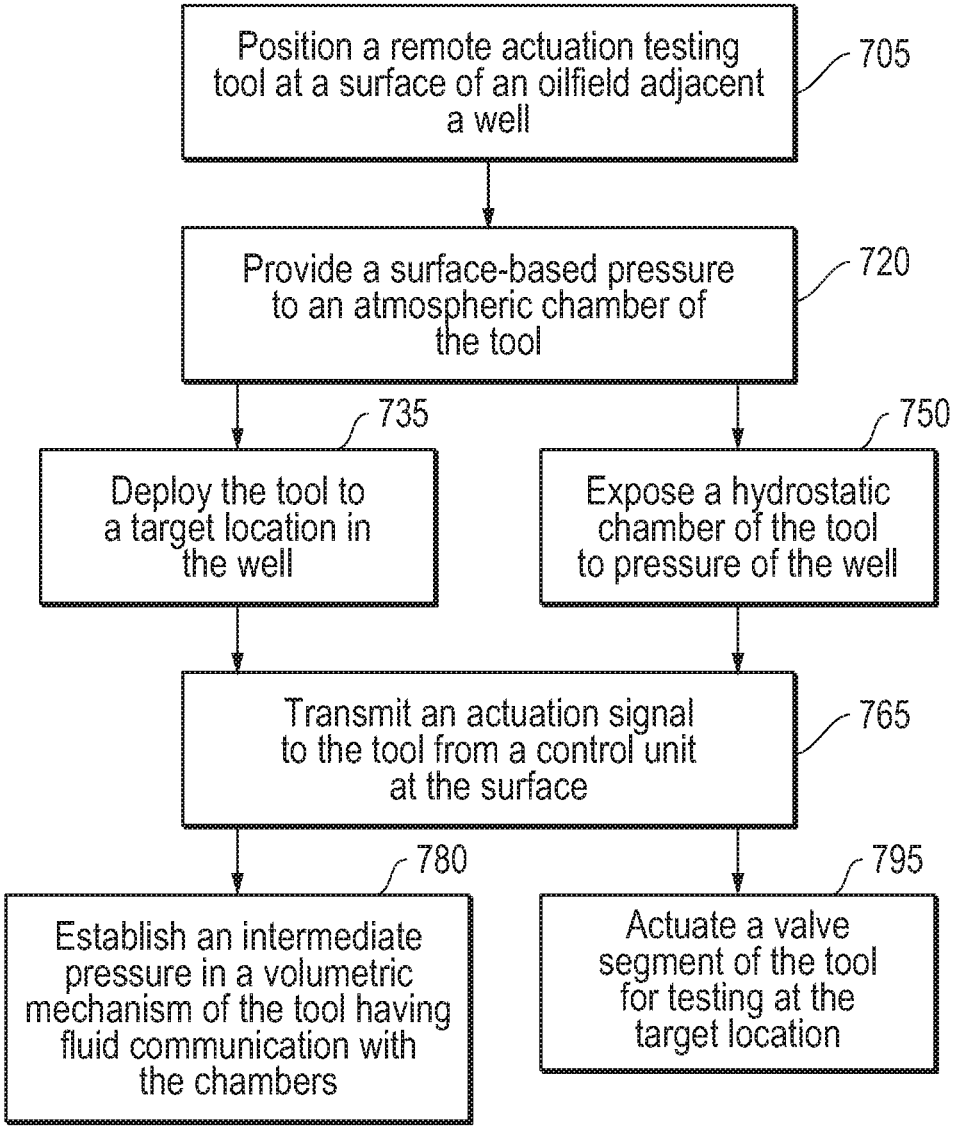
FIG. 7 is a flow-chart summarizing an embodiment of utilizing a remote actuation testing tool of enhanced high pressure differential capacity in a well.

Referring now to FIG. 7, a flow-chart summarizing an embodiment of utilizing a remote actuation testing tool of enhanced high pressure differential capacity is shown. The tool may be positioned at an oilfield where the atmospheric chamber is provided with a surface-based pressure (see 705, 720). That is, an atmospheric pressure of between about 0-200 PSI may be supplied. Although, in one embodiment, the chamber may actually be pressurized above 200 PSI, for example, with inert nitrogen. Nevertheless, the pressure in the atmospheric chamber would be considered 'surface-based' and below pressures of the well as described below.

As indicated at 735 and 750, the tool may then be deployed into the well with a hydrostatic chamber exposed to the noted well pressure. Further, once reaching the target location, an actuation signal may be transmitted from surface as noted at 765. This signal may be trigger valve actuation of the testing tool as indicated at 795. However, such takes place in conjunction with the establishing of an intermediate pressure within a volumetric mechanism of the tool (see 780). Thus, weaker hydraulic features of the tool may be exposed to an intermediate pressure of the mechanism as opposed to a potentially much larger pressure differential.

Embodiments detailed herein provide a testing tool that is able to utilize a downhole pressure differential for powering of valve actuations. However, in contrast to a conventional testing tool, tools of embodiments described herein are also equipped with the capacity to handle pressure differentials in excess of 35,000 PSI. Thus, valve failure may be substantially avoided in today's more common deeper, higher pressure and/or higher temperature well environments. As a result, time related costs associated with pressure related tool failure may be largely avoided along with the need for more cumbersome surface deployed power supply to the tool.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. This may include a variety of additional measures to enhance overall tool durability in light of excessively high pressure differential and/or temperatures of the downhole environment. For example, in one embodiment, the ball valve seat of the testing valve segment of the tool may be of a high strength polyether ether ketone (PEEK) as opposed to a more conventional polytetrafluoroethylene. Thus, the reliability of the valve in holding off excessive differential pressure at the ball-seat interface may be enhanced. Similarly, the atmospheric chamber or volumetric mechanism may be precharged with pressures above an atmospheric level so as to reduce the overall differential downhole (e.g. nitrogen may be utilized for such purposes). Along such lines, the foregoing description should not be read as pertaining only to the precise structures described and shown in the accompanying drawings, but rather should be read as consistent with and as support for the following claims, which are to have their fullest and fairest scope.

We claim:

1. A downhole tool for remote actuation in a well from an oilfield surface, the tool comprising:

a hydrostatic chamber for exposure to a downhole pressure in the well;

an atmospheric chamber of a surface-based pressure established at the surface;

an intermediate volumetric mechanism in fluid communication with said chambers and configured to retain a fluid pressure of below the downhole pressure and above the surface-based pressure; and a regulator to govern fluid pressure into said mechanism from said hydrostatic chamber; and a relief valve to govern fluid pressure release from said mechanism into said atmospheric chamber.

2. The tool of claim 1 wherein said regulator is an adjustable mechanical regulator.

3. The tool of claim 1 wherein said mechanism is selected from a group consisting of a discrete intermediate pressure chamber and a hydraulic line system.

4. The tool of claim 1 wherein the downhole pressure is over about 30,000 PSI and the intermediate pressure is between about 10,000 PSI and about 25,000 PSI.

5. The tool of claim 1 wherein the surface-based pressure is selected from a group consisting of atmospheric pressure below about 200 PSI and a charged pressure of inert gas over about 200 PSI supplied into the atmospheric chamber.

6. A downhole tool for remote actuation in a well from an oilfield surface, the tool comprising:

a hydrostatic chamber for exposure to a downhole pressure in the well;

an atmospheric chamber of a surface-based pressure established at the surface;

an intermediate volumetric mechanism in fluid communication with said chambers and configured to retain a fluid pressure of below the downhole pressure and above the surface-based pressure;

a power piston to carry out the actuation and in fluid communication with said chambers; and one of a circulating valve segment and a testing valve segment to perform a task of the actuation.

7. The tool of claim 6 wherein the testing valve segment comprises a ball valve and a seat of polyether ether ketone based material.

8. The tool of claim 6 further comprising a hydraulic sub segment coupled to said one of the circulating and testing valve segments and coupled to said chambers.

9. The tool of claim 8 wherein said hydrostatic chamber is coupled to said hydraulic sub at a first side thereof and said atmospheric chamber is coupled to said hydraulic sub at a second side thereof, opposite the first side.

10. The tool of claim 9 wherein said hydrostatic chamber is coupled to the first side of said hydraulic sub through said one of the circulating and testing valve segments disposed therebetween.

11. A downhole tool assembly for remote actuation in a well from an oilfield surface, the tool comprising:

a hydrostatic chamber for exposure to a downhole pressure in the well;

an atmospheric chamber of a surface-based pressure established at the surface; a power piston to carry out the actuation and in fluid communication with said chambers; and an intermediate volumetric mechanism in fluid communication with said chambers and configured to retain a fluid pressure of below the downhole pressure and above the surface-based pressure.

12. The assembly of claim 11 further comprising a pilot valve in hydraulic communication with said piston for amplification thereof.

13. The assembly of claim 12 wherein said pilot valve comprises o-rings for metal to metal sealing.

14. The assembly of claim 12 wherein said pilot valve comprises:

a normally open valve segment;

a normally closed valve segment adjacent said normally open valve segment; and a hydraulic circuit disposed between said segments to minimize fluid loss in the amplification of said piston.

15. A method of operating a testing tool in a well, the method comprising:

providing a surface-based pressure to an atmospheric chamber of the tool;

deploying the tool from an oilfield surface to a target location in a well;

exposing a hydrostatic chamber of the tool to pressure in the well;

establishing an intermediate pressure in a volumetric mechanism of the tool having fluid communication with the chambers, the intermediate pressure of a level between the surface-based pressure and the pressure in the well; and running one of an interventional and a sampling application with an assembly coupled to the tool.

16. The method of claim 15 further comprising:

transmitting a wireless actuation signal to the tool from equipment at the surface; and actuating a valve segment of the tool for a testing application at the target location.

17. The method of claim 15 wherein the interventional application is a perforating application employing a perforating gun.

18. The method of claim 15 wherein the sampling application comprises employing a tail pipe and sensor assembly.

* * * * *